US006598295B1

(12) United States Patent
Utter

(10) Patent No.: US 6,598,295 B1
(45) Date of Patent: Jul. 29, 2003

(54) PLATE-FIN AND TUBE HEAT EXCHANGER WITH A DOG-BONE AND SERPENTINE TUBE INSERTION METHOD

(75) Inventor: Robert E. Utter, Adrian, MI (US)

(73) Assignee: Brazeway, Inc., Adrian, MI (US)

( * ) Notice: Subject to any disclaimer, the term of this patent is extended or adjusted under 35 U.S.C. 154(b) by 0 days.

(21) Appl. No.: 10/093,266

(22) Filed: Mar. 7, 2002

(51) Int. Cl.[7] ..... B21D 53/08; B23P 15/26; F28D 1/047

(52) U.S. Cl. ..... 29/890.047; 29/726; 165/151

(58) Field of Search ..... 165/150, 151, 165/172; 29/890.047, 890.043, 726

(56) References Cited

U.S. PATENT DOCUMENTS

| | | | | |
|---|---|---|---|---|
| 1,793,244 A | | 2/1931 | Phelps | |
| 1,836,619 A | * | 12/1931 | Ritter | 29/890.047 |
| 2,840,352 A | * | 6/1958 | Ghai et al. | 165/151 |
| 2,983,483 A | * | 5/1961 | Modine | 165/151 |
| 3,645,330 A | | 2/1972 | Albright et al. | |
| 4,778,004 A | | 10/1988 | Paulman et al. | |
| 4,789,027 A | | 12/1988 | Diethelm | |
| 4,815,531 A | * | 3/1989 | Presz et al. | 165/151 |
| 4,869,316 A | | 9/1989 | Yoshida et al. | |
| 4,881,311 A | | 11/1989 | Paulman et al. | |
| 4,984,626 A | | 1/1991 | Esformes et al. | |
| 5,009,263 A | | 4/1991 | Seshimo et al. | |
| 5,183,105 A | | 2/1993 | Adams | |
| 5,509,469 A | | 4/1996 | Obosu | |
| 5,535,820 A | | 7/1996 | Beagle et al. | |
| 5,660,230 A | | 8/1997 | Obosu et al. | |
| 5,927,393 A | | 7/1999 | Richter et al. | |
| 6,125,925 A | | 10/2000 | Obosu et al. | |
| 6,253,839 B1 | * | 7/2001 | Reagen et al. | 165/151 |

FOREIGN PATENT DOCUMENTS

| | | | |
|---|---|---|---|
| JP | 61-6593 | * | 1/1986 |

* cited by examiner

*Primary Examiner*—Leonard R Leo
(74) *Attorney, Agent, or Firm*—Harness, Dickey & Pierce, P.L.C.

(57) ABSTRACT

A dog-bone type heat exchanger having a plurality of fin members for dissipating heat. Each of the plurality of fin members includes a pair of offset surfaces interconnected by a sloped interconnecting surface. The plurality of fins members may be spaced apart at a distance that is less than, equal to, or more than the offset distance between the pair of offset surfaces on each fin member, thereby maximizing the mixing of air flow and the conductive heat transfer of the heat exchanger through an impinging effect.

3 Claims, 2 Drawing Sheets

PLATE-FIN AND TUBE HEAT EXCHANGER WITH A DOG-BONE AND SERPENTINE TUBE INSERTION METHOD

FIELD OF THE INVENTION

The present invention generally relates to heat exchangers and, more particularly, relates to a heat exchanger having heat transfer elements with improved heat transfer characteristics.

BACKGROUND OF THE INVENTION

Conventional heat exchangers of the plate fin-tube type generally include of a plurality of parallel tubes having a plurality of perpendicular fins. The plurality of perpendicular fins is thermally coupled to the plurality of parallel tubes to serve as an evaporator. Heat absorbing fluid is forced through a capillary tube into the plurality of parallel tubes at a low temperature and pressure. Subsequent evaporation of the fluid removes heat energy from the air passing adjacent the tubes of the evaporator, thus cooling the air. The fins attached to the tube increase the effective heat absorbing area over which the airflow is directed, thus increasing the cooling efficiency of the evaporator. A small motor driven fan is utilized to draw air over the heat absorbing area of the evaporator and discharge the cooled air into the interior of the refrigerator.

Several attempts have been made to increase the cooling efficiency of the evaporator by varying the arrangement of the tube pattern and fin shape. U.S. Pat. No. 4,580,623 discloses a heat exchanger having parallel rows of serpentine tube coils slanting in the same direction and using ultra thin fins having a pattern embossed thereon to induce turbulence in the airflow over the evaporator. However, the refrigeration industry is currently requiring a wider evaporator to increase the face area of the evaporator met by the airflow to reduce the effects of frost growth and thereby increase the cooling efficiency of the refrigerator system. To enhance the cooling efficiency it is possible to add additional rows of tubes or additional fins to the evaporator. However, additional fins generally cause a narrowing of the space between fins, which may limit airflow there between and increase the amount of material necessary to manufacture the evaporator, thus increasing cost. Further, additional rows of fins may also lead to excessive air-pressure drops across the fins, especially as frost accumulates on the fins and tubes.

A need to improve the cooling efficiency of the current fin design is particularly felt in the area of "dog-bone" type heat exchangers. Dog-bone type heat exchangers generally include a plurality of fins each having a series of slots formed therein. These slots are generally in the shape of a dog bone—having generally circular end portions and a slightly narrower intermediate, connecting portion. Unlike other heat exchanger types, dog-bone heat exchangers employ a single, continuous tube that is bent into a serpentine-like pattern, which traverse back and forth through the series of slots formed in the fins once assembled. This single, continuous tube eliminates the need for complicated tube assembly, such as assembly and brazing of joints. The tube is bent into its preferred shaped prior to insertion through the dog-bone slots. Due to the narrower immediate portion of the dog-bone slots, the bends along at least one side of the final tube shape are crimped to enable insertion of the tube into the fins. This tube bundle is then inserted through the dog-bone slots to form the assembly. Traditionally, it is difficult to hold the fins in proper position during this insertion stage. Experience has shown that this difficulty is compounded if an irregularly shaped fin is used.

Dog-bone type heat exchangers are often used in refrigeration applications, such as refrigerator-freezer applications. Refrigeration applications typically use a lower airflow rate relative to commercial cooling systems. These lower airflow rates decrease the cooling capacity of the heat exchanger. Moreover, such refrigerator-freezer applications further require that frost be able to collect on the fins and tubes. Therefore, to minimize the chance of the fins being clogged with frost, the fins must be placed further apart to allow air to continue to pass through the evaporator as the frost accumulates. This increase separation of the fins limits the number of fins used and, furthermore, reduces the mixing of the airflow around the fins, thereby reducing the cooling capacity of the system. However, irregularly shaped fins are difficult to assemble with the continuous tube.

Accordingly, there exists a need in the relevant art to provide a dog-bone type heat exchanger system having evaporator fins that permit the accumulation of frost and the pass through of air, yet provides improved cooling capacity. Furthermore, there exists a need in the, relevant art to provide a dog-bone type heat exchanger having sufficiently spaced fins that provides improved mixing of the airflow around such fins to improve cooling capacity. Still further, there exists a need in the relevant art to provide a dog-bone type heat exchanger system having fins capable of improving the mixing of the airflow around such fins without adversely affecting the ease of assembly. Lastly, there exists a need in the relevant art to provide a dog-bone type heat exchanger system that overcomes the disadvantages of the prior art.

SUMMARY OF THE INVENTION

According to the principles of the present invention, a dog-bone type heat exchanger is provided having an advantageous construction and method of assembly. The dog-bone type heat exchanger includes a plurality of fin members for dissipating heat. Each of the plurality of fin members includes a pair of offset surfaces interconnected by a sloped interconnecting surface. The plurality of fins members may be spaced apart at a distance that is less than, equal to, or more than the offset distance between the pair of offset surfaces on each fin member.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment is merely exemplary in nature and is in no way intended to limit the invention, its application, or uses.

Referring to FIGS. 1–4, an evaporator system, generally indicated at 10, is illustrated for use in a refrigeration system (not shown). The refrigeration system generally includes a refrigerator having a spaced apart wall section forming a passageway. Evaporator system 10, in accordance with the present invention, is placed in the passageway and is used to cool the air drawn over evaporator system 10 and is discharged into the refrigerator by a fan. Evaporator system 10, when used in a restaurant appliance, is generally operated at a temperature such that frost tends to collect on the surfaces of the evaporator. Accordingly, evaporator system 10 must include pathways extending there through to permit the passage of air to prevent clogging of the evaporator. Should the evaporator system become clogged, the airflow over the evaporator is reduced causing an airside pressure drop and a decrease in the cooling efficiency of the device (i.e., reducing the airflow over evaporator system 10 reduces the amount of cool air discharged into the refrigerator). In an attempt to keep the refrigerator at the desired temperature level, the system works harder (i.e., the compressor runs almost continuously to provide a supply of heat absorbing fluid to evaporator system 10 in an attempt to provide additional cool air to the refrigerator).

Figure 1:
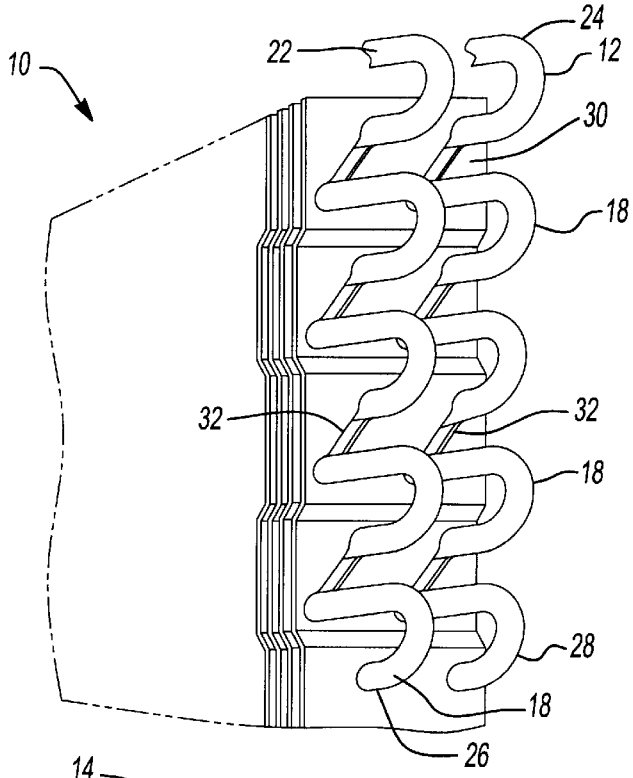
FIG. 1 is a perspective view illustrating an evaporator according to the principles of the present invention.
Figure 2:
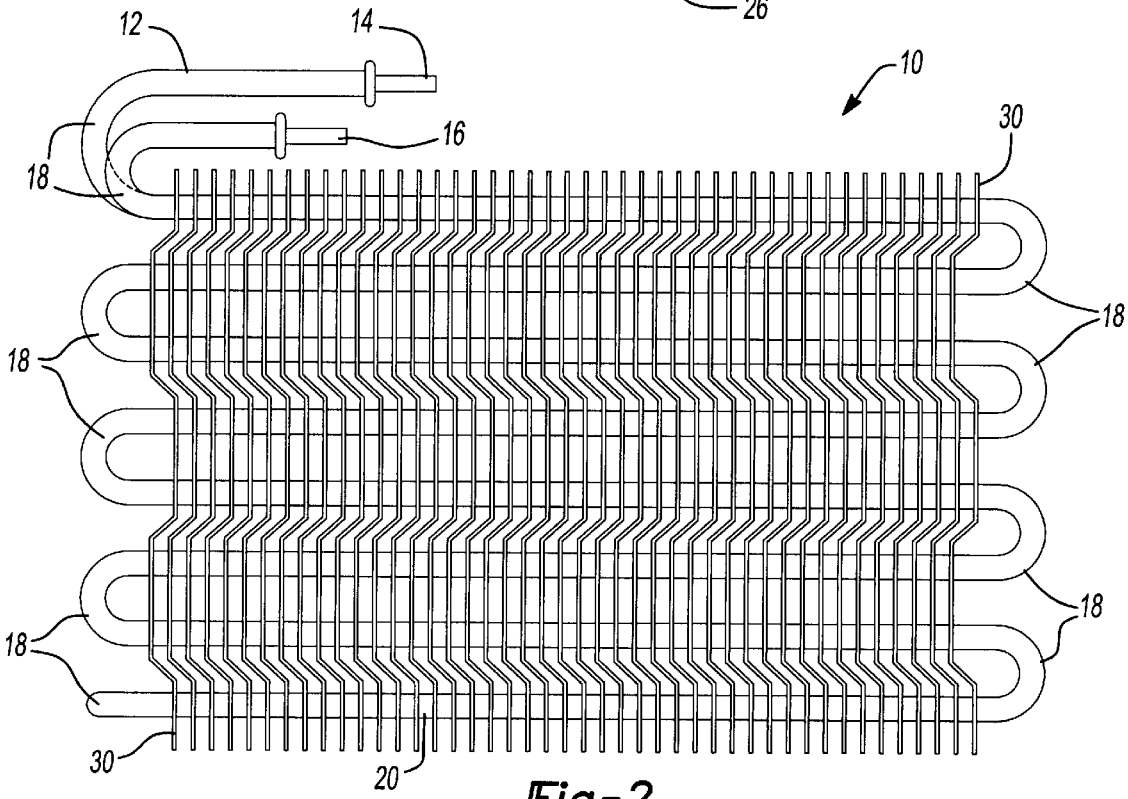
FIG. 2 is an elevational view illustrating the evaporator of the present invention.
Figure 3:
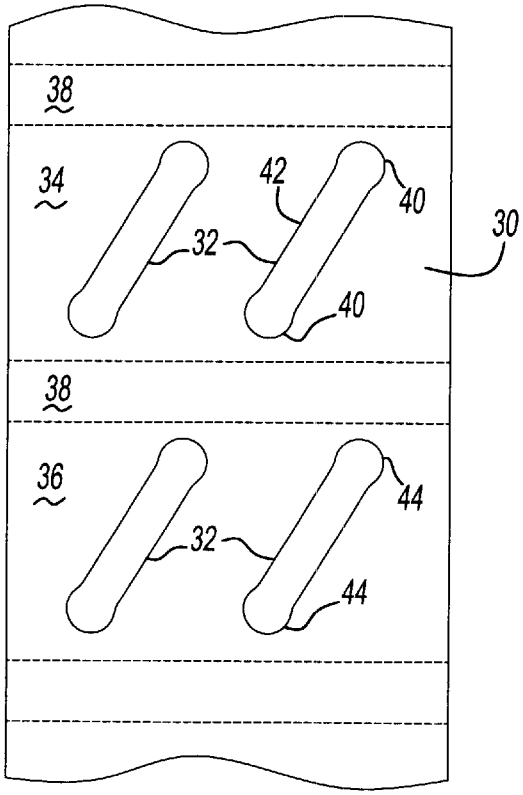
FIG. 3 is a front view illustrating the dog-bone slots.

Evaporator system 10 of the preferred embodiment comprises a continuous tube 12 having both inlet 14 and outlet 16 ends. Continuous tube 12 is formed in a serpentine configuration by a plurality of reverse bends 18 and parallel tube runs 20. As best seen in FIGS. 1 and 3, continuous tube 12 is folded into an essentially bi-planar configuration resulting in two adjacent rows of tubes 22, 24. Tube rows 22, 24 are made up of sets of two parallel tubes 26, 28 with the exit of each set connected to the entrance of the next successive set in the respective row by a respective reverse bend 18. The sets of parallel tubes in each row 22, 24 are sloped in co-planar directions relative to the longitudinal axis of tube row 22, 24.

Figure 4:
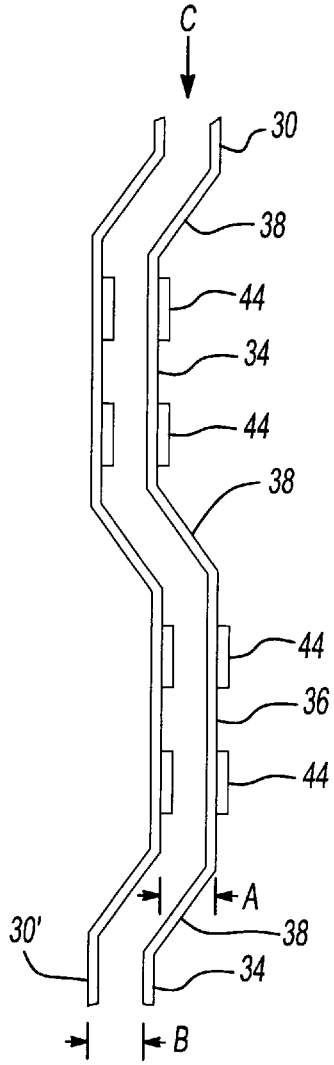
FIG. 4 is a side view illustrating the profile configuration of the fin according to the present invention.

As best seen in FIGS. 1, 3, and 4, fins 30 each include a varying profile capable of dramactically enhancing the mixing of the air flow passing through evaporator system 10 and further capable of enhancing the impingeing effect of air contacting each fin 30. With particular reference to FIGS. 3 and 4, fins 30 each includes a first surface 34 and a second surface 36. According to the present embodiment, first surface 34 is a planar surface that is parallel to and offset from second planar surface 36 as indicated at A. First surface 34 and second surface 36 are interconnected via a sloping, interconnecting surface 38. Preferably, fin 30 further includes a plurality of first surfaces 34 and second surfaces 36 each interconnected in a similar manner by sloping, interconnecting surface 38. Most preferably, first surface 34 and second surface 36 alternate after each pair of slots 32, thereby providing the maximum number of alternating surfaces 34, 36, while maintaining a generally flat surface adjacent slots 32 for assembly. This will be discussed further below. It should be noted, however, that the exact dimensions and shape of fins 30 may be modified to accomodate the particular needs of the intended application. The planar shape of first surface 34 and second surface 36 is preferably oriented perpendicular to the direction of insertion of continuous tube 12.

Still referring to FIGS. 3 and 4, fins 30 are preferably made of stamp-formed aluminum having a thickness of about 0.15 mm. More particularly, fins 30 are preferably stamp-formed in a single manufacturing step to form the outer dimensions of fin 30, slots 32, first surface(s) 34, second surface(s) 36, and interconnecting surface(s) 38. As best seen in FIG. 3, slots 32 each include a pair of generally circular portions 40 having a generally narrower intermediate portion 42 extending between the pair of generally circular portions 40. Referring now to FIG. 4, the pair of generally circular portions 40 each include an outwardly-turned collar portion 44 being stamp-formed to provide a generally non-abrasive surface for contacting continuous tube 12. Collar portion 44 further serves to provide an enlarged contact surface area to improve conductive heat transfer between continuous tube 12 and each fin 30.

Fins 30 are secured on continuous tube 12 by inserting bends 18 of continuous tube 12 into canted slots 32 of fins 30. The overall length of slot 32 is slightly less than the overall outer dimension of the set of two tubes. Since the overall length of the slot is slightly less than the overall outer dimension of the set of two tubes, the tube sets are press fit into slots 32 to ensure metal-to-metal contact, which enhances heat conduction between the tube walls and fins 30. Fins 30 are evenly spaced on tube 12 and when used in refrigeration units are normally spaced three-to-six fins per inch of tube.

Figure 5:
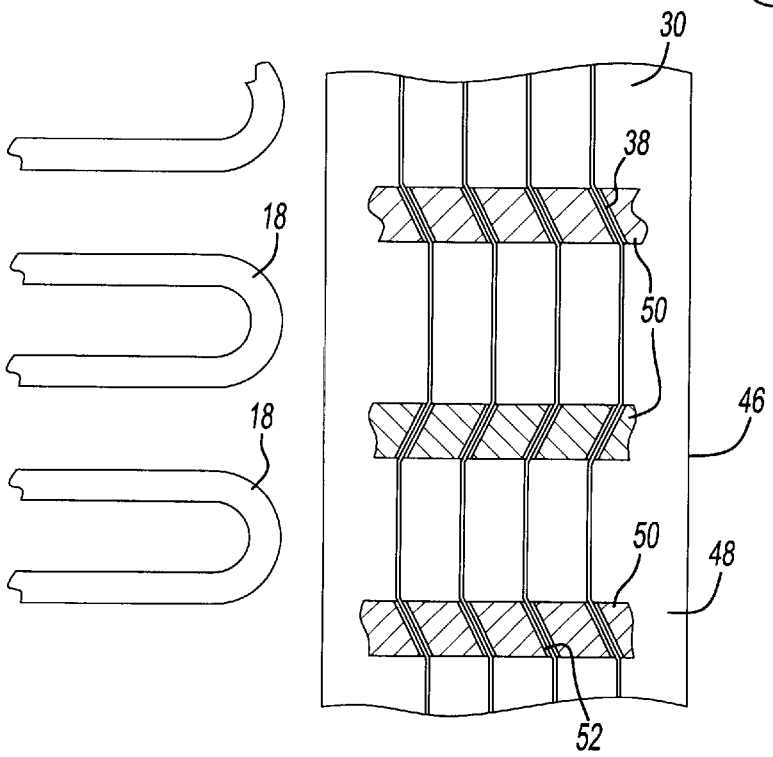
FIG. 5 is a plan view illustrating the insertion of the tube bundle into a plurality of fins being secured within a jig member.

As best seen in FIG. 5, assembly of fins 30 and continuous tube 12 is facilitated with the use of a jig member 46. Jig member 46 generally includes a base portion 48 and a plurality of support rails 50. The plurality of support rails 50 being generally orthogonal to base portion 48 and include a series of complimentary angled channels 52 to engage interconnecting surface 38 of fins 30. Accordingly, bends 18 of continuous tube 12 are inserted into respective slots 32 of fins 30, channels 52 of support rails 50 cooperate to retain fins 30 in proper position and spacing. Once insertion is complete, the final evaporator system 10 may be removed from jig member 46.

The cooling efficiency of evaporator system 10 of the present invention may be further improved over conventional designs as a result of the particular offset and profile of fins 30. With reference to FIG. 4, an example of the planar-offset configuration of fins 30 is illustrated. Although it should be appreciated that fins 30 may be spaced apart any distance that is found to maximize heat exchange, in this example fin 30 and an adjacent fin 30' are offset a distance B that is at least less than or equal to the offset distance A between first surface 34 and second surface 36. Moreover, again relative to this particular example, distance B remain less than or equal to distance A despite various fin shapes. Such an arrangement leads to improved mixing of airflow C passing between fin 30 and fin 30'. In other words, such arrangement eliminates any straight through passage lines extending between adjacent fins, thereby requiring mixing of airflow and maximizing the amount of air molecules impinging upon interconnecting surfaces 38. The impinging of air molecules on interconnecting surfaces 38 improves the heat transfer between the air and continuous tube 12, thus improving the cooling efficiency of evaporator system 10. By improving the cooling efficiency, the amount of work required may be reduced and/or the spacing of fins 30 may be increased to facilitate the flow of air between adjacent fins 30 as frost accumulates on fins 30.

It has been seen that as air is drawn over evaporator system 10, the air impinges the cooling fins and further mixes, thereby increasing the cooling effect and efficiency of evaporator system 10 over prior art evaporators having flat fin designs. Accordingly, the invention results in lower manufacturing costs, since unnecessary fins may be removed. Furthermore, as a result of the option to use increased spacing between adjacent fins, the pressure drop is minimized, which enables the use of a smaller fan and compressor motor, thus decreasing operating costs and noise.

However, in summary, it is important to note that preferably the fins of the present invention include a plurality of offset planar surfaces. These offset planar surface preferably alternative between each pass of the tubing, thus maximizing the number of alternating surface while still maintaining the necessary perpendicular relationship with the tubing. This perpendicular relationship eases assembly in that a plurality of fins may be easily held in a jig at which time the preformed serpentive tubing is easily inserted.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method of assembling a dog-bone type heat exchanger, said method comprising:

providing a base member having a plurality of spaced support members coupled thereto forming support channels therebetween;

providing a pair of fin members each having a first surface and a second surface interconnected by a first sloped interconnecting surface, a plane of said first surface being offset from a plane of said second surface, at least said first surface having a plurality of slots formed therethrough, each of said plurality of slots having a pair of generally circular portions and an intermediate portion;

inserting each of said pair of fin members into said corresponding support channels formed in said base member and retaining each of said pair of fin members along only said interconnecting surface using only said support channel;

providing a continuous tube having a plurality of reverse bends forming a plurality of parallel tube runs; and inserting each of said plurality of reverse bends through a corresponding one of said plurality of slots formed in said pair of fin members.

2. The method of assembling a dog-bone type heat exchanger according to claim 1 wherein said step of providing a pair of fin members includes providing said pair of fin members wherein the width of said intermediate portion is smaller than a diameter of each of said pair of generally circular portions, thereby generally defining a dog-bone shape.

3. The method of assembling a dog-bone type heat exchanger according to claim 1, further comprising:

spacing said pair of fin members a distance that is greater than or equal to a distance between said plane of said first surface and said plane of said second surface.

* * * * *